US008360842B2

(12) United States Patent
Simon

(10) Patent No.: US 8,360,842 B2
(45) Date of Patent: Jan. 29, 2013

(54) POKER-LIKE GAME BASED ON A LIVE SPORTING EVENT

(76) Inventor: Burton Simon, Silverthorne, CO (US)

( * ) Notice: Subject to any disclaimer, the term of this patent is extended or adjusted under 35 U.S.C. 154(b) by 302 days.

(21) Appl. No.: 12/756,091

(22) Filed: Apr. 7, 2010

(65) Prior Publication Data

US 2010/0259005 A1 Oct. 14, 2010

Related U.S. Application Data

(60) Provisional application No. 61/168,084, filed on Apr. 9, 2009.

(51) Int. Cl.
*A63F 13/00* (2006.01)
*A63F 1/00* (2006.01)

(52) U.S. Cl. ..... 463/16; 463/42; 273/244.2; 273/247; 273/298

(58) Field of Classification Search ..... 273/247, 273/244.1, 244.2, 245, 246, 298; 463/16, 463/42

See application file for complete search history.

(56) References Cited

U.S. PATENT DOCUMENTS 4,429,877 A 2/1984 Coppock
4,540,174 A 9/1985 Coppock
4,592,546 A 6/1986 Fascenda
4,836,553 A 6/1989 Suttle
4,953,873 A * 9/1990 Jacobson ..... 273/274
5,283,734 A 2/1994 Von Kohorn
5,462,275 A 10/1995 Lowe
5,564,701 A 10/1996 Dettor
5,564,977 A 10/1996 Algie
5,573,244 A 11/1996 Mindes
5,683,090 A 11/1997 Zeile et al.
5,772,512 A 6/1998 Chichester
5,830,069 A 11/1998 Soltesz et al.
5,956,485 A 9/1999 Perlman
5,957,775 A 9/1999 Cherry
5,984,779 A 11/1999 Bridgemann et al.
6,007,427 A 12/1999 Wiener
6,015,345 A 1/2000 Kail
6,048,271 A 4/2000 Barcelou
6,102,797 A 8/2000 Kail
6,106,395 A 8/2000 Begis
6,120,376 A 9/2000 Cherry
6,126,543 A 10/2000 Friedman
6,152,822 A 11/2000 Herbert
6,209,872 B1 * 4/2001 Caswell ..... 273/244.2
6,287,199 B1 9/2001 McKeown
6,296,250 B1 10/2001 Langan
6,331,148 B1 12/2001 Krause et al.
6,338,486 B1 * 1/2002 Hutchens ..... 273/298
(Continued)

OTHER PUBLICATIONS

Manuel Morales, "Tempt Destiny", 2006, Maveric Inc., Retail Store Rules and Box.*

*Primary Examiner* — Benjamin Layno
(74) *Attorney, Agent, or Firm* — Greenlee Sullivan P.C.

(57) ABSTRACT

A poker-like game played during a live sporting event utilizing cards corresponding to scores, statistics, teams, athletes and various contingencies associated with the sporting event. The game is preferably played during a live sporting event with a sequence of betting events. A player can make a bet during a betting event, as long as said player is still in the game, and as long as said player was not the last player to make a bet. If a player makes a bet, then each of the remaining players must call the bet within a given time or fold. The values of the cards are determined by the outcome of the sporting event, so they are not known with certainty until the betting event terminates. When the betting event terminates, the remaining player with the best hand, as determined by the values of the cards, wins the pot.

17 Claims, 11 Drawing Sheets

PLAYER SCREEN

U.S. PATENT DOCUMENTS

| | | | | |
|---|---|---|---|---|
| 6,379,248 | B1 | 4/2002 | Jorasch et al. | |
| 6,394,895 | B1 | 5/2002 | Mino | |
| 6,450,887 | B1 | 9/2002 | Mir et al. | |
| 6,468,156 | B1 | 10/2002 | Hughs-Bairn et al. | |
| 6,634,946 | B1 | 10/2003 | Bridgemann et al. | |
| 6,663,107 | B2 * | 12/2003 | Fisher et al. | 273/292 |
| 6,666,769 | B2 | 12/2003 | Stronach | |
| 6,783,128 | B2 * | 8/2004 | Casey et al. | 273/298 |
| 7,172,508 | B2 | 2/2007 | Simon | |
| 7,341,517 | B2 | 3/2008 | Asher et al. | |
| 7,351,149 | B1 | 4/2008 | Simon | |
| 2005/0227757 | A1 | 10/2005 | Simon | |
| 2009/0051115 | A1 * | 2/2009 | Thrasher | 273/298 |
| 2009/0085297 | A1 * | 4/2009 | Morales | 273/298 |

* cited by examiner

PLAYER SCREEN

HOUSE SCREEN

| QB | RB | WR | TE |
|---|---|---|---|
| 1 point per passing yard<br>5 points per 1st down passing<br>10 points for TD pass<br><br>601 | 1 point per rushing yard<br>1 point per receiving yard<br>5 points per 1st down<br>10 points for TD<br><br>602 | 1 point per receiving yard<br>5 points per 1st down<br>10 points for TD<br><br>603 | 1 point per receiving yard<br>5 points per 1st down<br>10 points for TD<br><br>604 |
| **D** | **TD** | **FG** | **PUNT** |
| 10 points per sack<br>5 points per loss-on-play<br>-20/-5 points if offense scores TD/FG<br>10 points if offense does not score<br>20 points for Turnover<br><br>605 | 25 points for a Touchdown<br><br>606 | 10 points for a Field Goal<br><br>607 | 10 points for a punt<br><br>608 |
| **XFG** | **TurnOver** | **Fumble** | **INT** |
| 30 points for a missed Field Goal<br><br>609 | 30 points for a Turnover<br><br>610 | 50 points for a fumble<br><br>611 | 50 points for an interception<br><br>612 |

FIGURE 6A

| | | | |
|---|---|---|---|
| **1st Downs**<br><br>5 points for each 1st Down<br><br>613 | **3 & OUT**<br><br>20 points for a Three and Out possession<br><br>614 | **Official Review**<br><br>20 points for an Official Review<br>10 additional points if the Official Review overturns a call<br><br>615 | **Sacks**<br><br>20 points for each sack<br><br>616 |
| **Penalties**<br><br>1 point<br>per penalty yard<br><br>617 | **Long Gain**<br><br>1 point<br>per yard on longest play<br><br>618 | **Big Play**<br><br>50 points if Defense scores, if there is a TD greater than 50 yards, if special teams score, or if there is a safety<br><br>619 | **2 Point Conversion**<br><br>15 points for a Two Point Conversion attempt; +10 additional points if successful<br><br>620 |
| **3rd Down Conversion**<br><br>5 points per 3rd Down Conversion<br><br>621 | **4th Down Conversion**<br><br>5 points per 4th Down Conversion<br><br>622 | **Clock**<br><br>20 points if last drive of half or game<br><br>623 | **Time Out**<br><br>10 points per Time Out used<br><br>624 |

FIGURE 6B

| Center Fielder | Second Baseman | Designated Hitter | Third Baseman |
|---|---|---|---|
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Center Field<br><br>701 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Second Base<br><br>702 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston DH<br><br>703 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Third Base<br><br>704 |
| First Baseman | Right Fielder | Left Fielder | Short Stop |
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>First Base<br><br>705 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Right Field<br><br>706 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Left Field<br><br>707 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Short Stop<br><br>708 |
| Catcher | Starting Pitcher | Relief Pitcher 1 | Relief Pitcher 2 |
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>Boston<br>Catcher<br><br>709 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>Boston<br>Pitcher<br><br>710 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>Boston<br>Relief Pitcher<br><br>711 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>Boston<br>Relief Pitcher<br><br>712 |

FIGURE 7A

| Left Fielder | Short Stop | First Baseman | Third Baseman |
|---|---|---|---|
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Left Field<br><br>713 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Short Stop<br><br>714 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>First Base<br><br>715 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Third Base<br><br>716 |
| **Catcher** | **Right Fielder** | **Designated Hitter** | **Second Baseman** |
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Catcher<br><br>717 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Right Field<br><br>718 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>DH<br><br>719 | At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Second Base<br><br>720 |
| **Center Fielder** | **Starting Pitcher** | **Relief Pitcher 1** | **Relief Pitcher 2** |
| At Bat .....5 pts<br>On Base .....10 pts<br>Hit .....5 pts per base<br>RBI .....5 pts<br>Run Scored ..10 pts<br>Stolen Base ..10 pts<br>Put Out ..... 5 pts<br>Assist ..... 30 pts<br>Error ..... -10 pts<br><br>New York<br>Center Field<br><br>721 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>New York<br>Pitcher<br><br>722 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>New York<br>Relief Pitcher<br><br>723 | Strike Outs 5 pts for 1st<br>10 pts for 2nd<br>20 pts for 3rd<br><br>1-2-3 Inning ...10 pts<br>0 Runs allowed....10 pts<br>Runs Scored -5 pts per<br>Error ..... -10 pts per<br><br>New York<br>Relief Pitcher<br><br>724 |

FIGURE 7B

| | | | |
|---|---|---|---|
| HITS<br>6 pts<br>Per Hit<br>725 | HITS<br>7 pts<br>Per Hit<br>726 | HITS<br>8 pts<br>Per Hit<br>727 | ERROR<br>20 pts<br>Per Error, Wild Pitch or Passed Ball<br>728 |
| RUNS<br>10 pts<br>Per Run<br>729 | RUNS<br>11 pts<br>Per Run<br>730 | RUNS<br>12 pts<br>Per Run<br>731 | ERROR<br>25 pts<br>Per Error, Wild Pitch or Passed Ball<br>732 |
| Strike Outs<br>7 pts<br>Per Strike Out<br>733 | Strike Outs<br>8 pts<br>Per Strike Out<br>734 | Strike Outs<br>9 pts<br>Per Strike Out<br>735 | Pitching Change<br>15 pts<br>Per Pitching Change<br>736 |

FIGURE 7C

| | | | |
|---|---|---|---|
| Home Run<br>25 pts<br>Per Home Run<br>737 | Home Run<br>26 pts<br>Per Home Run<br>738 | Home Run<br>27 pts<br>Per Home Run<br>739 | Pitching Change<br>15 pts<br>Per Pitching Change<br>740 |
| WALKS<br>10 pts<br>Per walk or HBP<br>741 | WALKS<br>14 pts<br>Per walk or HBP<br>742 | LOB<br>5 pts .....1 LOB<br>10 pts .... 2 LOB<br>30 pts .... 3 LOB<br>743 | Lead Change<br>10 pts...Catch up and Tie<br>20 pts...Take Lead<br>30 pts...Catch Up and take Lead<br>744 |
| Big Play<br>50 pts<br>If one of the following occurs:<br>Grand Slam<br>Outfield Assist<br>Ground Rule Double<br>Runner Picked Off/Caught Stealing<br>Runner Out at Plate<br>Back to Back Home Runs<br>Triple<br>In-the-Park Home Run<br>Player or Coach Ejected<br>745 | Big Play<br>50 pts<br>If one of the following occurs:<br>Grand Slam<br>Outfield Assist<br>Ground Rule Double<br>Runner Picked Off/Caught Stealing<br>Runner Out at Plate<br>Back to Back Home Runs<br>Triple<br>In-the-Park Home Run<br>Player or Coach Ejected<br>746 | Big Play<br>51pts<br>If one of the following occurs:<br>Grand Slam<br>Outfield Assist<br>Ground Rule Double<br>Runner Picked Off/Caught Stealing<br>Runner Out at Plate<br>Back to Back Home Runs<br>Triple<br>In-the-Park Home Run<br>Player or Coach Ejected<br>747 | 1-2-3<br>20 pts<br>If Batters are Retired 1-2-3<br>748 |

FIGURE 7D

POKER-LIKE GAME BASED ON A LIVE SPORTING EVENT

CROSS-REFERENCE TO RELATED APPLICATIONS

This application claims priority to U.S. Provisional Application Ser. No. 61/168,084, filed Apr. 9, 2009, which is hereby incorporated by reference in its entirety to the extent not inconsistent with the disclosure herewith

BACKGROUND OF THE INVENTION

The present invention relates to card games, and more particularly poker-like card games played with cards whose values are not known with certainty during the round. The present invention also relates to in-game (also called in-progress or real-time) betting games based on live sporting events, and more particularly poker-like in-game betting games that are based on live sporting events. The game of the present invention can be played on a web site over the internet, or in a physical location like a sports bar or casino.

The ancestry of modern poker goes back at least 1000 years. Poker-like games were played by Chinese emperors in the $10^{th}$ century. The modern deck of cards used for modern poker (and other card games, like bridge) also has ancient roots. A game called Primero, played in Spain in the $16^{th}$ century is often called "poker's mother". By the $17^{th}$ and $18^{th}$ century there were games called "Pogue" in French, and "Pochen" in German, that can be directly linked to the modern poker games.

A key aspect of poker and poker-like games is the bluff. A bluff is a wager (often large) made by a player with a poor hand. The object of a bluff is to fool the opponent players into thinking the bluffer's hand is, in fact, good. That way, an opponent with a better hand may drop out of the round (i.e., fold) allowing the bluffer to win. On the Mississippi River boats of the $19^{th}$ century, poker-like games were referred to as "cheating games", no doubt because bluffing appears on the surface to be a type of cheating. But it is not. Bluffing is, in fact, a subtle strategy that every good poker player must understand. Twentieth century mathematicians, like John Von Neumann, were able to calculate the optimal bluffing strategies for simple poker-like games. But for the popular poker games, like Stud Poker and Texas Hold'em, the optimal strategies are too complex to analyze mathematically, so the best human players are better than any computer "player". In that sense, modern poker is a more difficult strategy game than chess.

Today, when one speaks of poker, one is referring to a collection of games (Texas Hold'em, Stud Poker, Draw Poker, etc.) that are played with a standard 52 card deck. The present invention is a "poker-like" game in that it involves bluffing of the same sort used in poker games, and therefore it is a game of skill that involves the same sorts of subtle strategies as poker.

The present invention is also a type of in-game sports betting (also called in-progress betting and real-time betting in other contexts). Traditional sports betting involves players making bets based on the outcome of a sporting event before said sporting event begins. In-game sports betting allows players to place bets on outcomes associated with a sporting events while said sporting event is in progress. While poker and poker-like games have been around for centuries, in-game betting is a much more recent phenomenon. In-game sports betting systems of two types can be found in the prior art. There are fixed-odds systems where a player knows what his payoff will be if he wins when he makes his bet, and there are parimutuel systems where the payoffs the players receive on winning bets are based on how much was wagered on each choice, and is not known precisely until the betting line closes.

There are many examples of variants of traditional poker. For example, U.S. Pat. No. 4,836,553, ("Poker game", Suttle, et. al.) discloses a variant of poker that is designed to be played in a casino against the house. However, the game uses traditional poker cards and house-initiated betting rounds. There is no poker or poker-like game in the prior arts that uses a deck of cards where the values of the cards depend on external events whose outcomes are not known with certainty while the rounds are in progress. There is also no poker or poker-like game known in the art that is dependent on a live sporting event. There is also no similar poker or poker-like game in the prior arts that features asynchronous and unstructured betting rounds.

There are also examples of in-game sports betting systems in the prior art. For example, U.S. Pat. No. 7,341,517, ("Real-time interactive wagering on event outcomes", Asher, et. al.) discloses a method for placing bets on a variety of types of betting events in real time over the internet. However, the sports bets are traditional fixed odds spread-bet types, and not based on a poker or poker-like game. There is no known in-game betting system based on a poker or poker-like game, so the prior art does not disclose any method for conducting an in-game sports betting operation based on a poker or poker-like game.

In view of the foregoing, it would be desirable to have a poker-like game that is played during a live event, preferably a live sporting event, and that cannot be played in the absence of a live event. It would also be desirable to have a poker-like game where the cards and hands are of uncertain value during the rounds of the game, and are not known exactly until the end of the round, and to have a poker-like game where the betting is asynchronous and unstructured. It would also be desirable to have a poker-like game that could be used to conduct an in-game sports betting operation. It would also be desirable to have a poker-like in-game sports betting game that can serve as a basis of new kinds of tournaments and contests that take place during live sporting events. It is believed that these modifications result in a fundamentally new type of poker-like game and a fundamentally new kind of sports betting.

SUMMARY OF THE INVENTION

The present invention provides a poker-like game played during a live event with a special deck of cards designed specifically for that event. The cards correspond to various events and contingencies associated with the live event. Preferably, the game is played during a live sporting event having a sequence of betting events and utilizing cards corresponding to scores, statistics, teams, athletes and various contingencies associated with the betting events.

The values of the cards are determined by actions occurring during the betting event, so they are not known with certainty until the betting event terminates. When the betting event terminates, the remaining player with the best hand wins the pot. The best hand is determined by the final values of the cards in the hand. In one embodiment, a player can make a bet at any time during a betting event, as long as the player is still in the game, and as long as said player was not the last player to make a bet. If a player makes a bet, then each of the remaining players must call or raise the bet within a given time or fold. Optionally, one or more cards in each player's hand can be viewed by the other players. The game can be played over a computer network, such as the internet, or at a real poker table, such as at a casino or sports bar with a view of the live sporting event.

It is one object of the present invention to provide a betting game to a plurality of players over the internet, using a web site. Players play at virtual tables with virtual decks of cards, while they watch a live sporting event at home or at some other location. The website takes care of all administrative tasks at all the tables, such as dealing cards, moving and distributing chips, determining and paying off the winner.

It is another object of the present invention to provide a betting game to a plurality of players at a sports bar or casino. Players play at real tables with physical cards. The live sporting event is on TV monitors visible from the tables. Each table has a human dealer who takes care of local administrative tasks, such as dealing cards, moving and distributing chips, determining and paying off the winner.

It is another object of the present invention to provide a betting game based on the events unfolding during a live event, preferably a live sporting event. It is another object of the present invention to provide a betting game based on betting events associated with a live sporting event that occur sequentially during the live sporting event so that players can play a plurality of rounds of the betting game during the live sporting event.

It is another object of the present invention to provide a tournament based on the betting game, where each round in the tournament involves one or more tables of players, and the player accumulating the most chips at each table during one round moves on to the next round. It is another object of the present invention to provide an automated system for the administration of a betting game played over the internet, where different tables may utilize different decks of cards and different betting rules, and different tables may offer betting games based on different betting events, and even different sporting events.

It is another object of the present invention to provide a betting game with house rules, which specify when cards are dealt, the allowable sizes of bets, the allowed time players have to call a bet, and the size and timing of the antes.

These and other objects and advantages of the invention shall become apparent from the following general and preferred descriptions of the invention.

In one embodiment, the present invention provides a method of providing a betting game between a plurality of players, wherein the betting game is based on a live event comprising one or more betting events. The method comprising the steps of providing a deck of cards, wherein each card has a value determined by actions occurring during the one or more betting events; and distributing one or more cards from the deck to each player before or during a first betting event, wherein the value of the distributed cards are able to change during the course of the first betting event. The live event is monitored until a termination event occurs with regard to the first betting event. One or more betting rounds are provided during the first betting event until the termination event occurs, wherein during the betting rounds the plurality of players are allowed to place bets on the value of the cards distributed to the players. Upon termination of the first betting event, the final value of the distributed cards are determined for the terminated betting event and the winners of bets placed during the betting rounds are paid based on the final value of the cards. Preferably the live event is a sporting event and each card has a value based on statistics of a player or team accumulated in one or more betting events during the live sporting event.

In a further embodiment, the present invention further comprises providing a betting game based on a live event comprising a plurality of betting events. Cards are distributed to each player before or during the plurality of betting events, where the same cards distributed to the players can be used for each betting event, or different cards can be distributed to the players for each betting event. The value of the distributed cards for each betting event is able to change during the course of the betting event. The live event is monitored until a termination event occurs with regard to the plurality of betting events, and one or more betting rounds are provided during each of the plurality of betting events until the termination event occurs for that particular betting event, wherein during the betting rounds the players are allowed to place bets on the value of the cards distributed to the players. Upon termination of each of the plurality of betting events, the final value of the cards distributed to each player for the terminated betting events are determined and the winners of bets placed during the betting rounds are determined based on the final value of the cards.

In a further embodiment, the present invention provides a betting game and game tournaments having multiple game rounds, wherein each game round is based on one or more live events comprising one or more betting events. This method comprises the steps of providing one or more tables, wherein each table contains a plurality of players. A deck of cards is provided to each table, wherein each card has a value determined by actions occurring during the one or more betting events. For each table, one or more cards from the deck are distributed to each player at the table before or during one or more betting events, wherein the value of the distributed cards are able to change during the course of each betting event. The one or more live events are monitored until a termination event occurs with regard to the one or more betting events; and one or more betting rounds are provided for each table during the one or more betting events until the termination event occurs for each betting event. During the betting rounds, the players at each table are allowed to place bets on the value of the cards distributed to the players. Upon termination of each of the one or more betting events, a final value of the distributed cards for the terminated betting event are determined and the winners of bets placed at each table during the betting rounds are paid based on the final value of the cards. The bets are made using money, chips or tokens. After one or more betting events, players with the highest amount of money, chips or tokens from each table are advanced to the next game round, wherein the next game round comprises fewer tables and players. The next game round is played in the same manner as the previous game round but is based on a different live event or betting events and new cards are distributed to the players. Multiple game rounds can be played until the players reach a final table containing all of the remaining advanced players. At this point, a final game round can be played wherein the player with highest amount of money, chips or tokens at the end of the final round is declared the final winner.

In a further embodiment, the present invention further comprises collecting the bets placed during the betting rounds, and retaining a portion of the collected bets wherein the winners are paid with the remaining portion of the collected bets. In a further embodiment, the present invention further comprises collecting an ante from one or more players at the start of one or more betting rounds, and disqualifying players who do not contribute an ante. Disqualified players cannot be winners of bets placed during the betting rounds for that betting event. Typically, the ante round is initiated by the house or the entity administering the betting game. Optionally, a portion of the collected antes are retained and the winners of placed bets are paid the remaining portion of the collected antes along with the winnings from the bets. The bets and antes can be made using money, chips or tokens, where the chips or tokens can be purchased. In one embodiment, the game is provided and administered through a computer network. In this embodiment, the chips, tokens, tables and cards can be electronic units maintained on a computer processor.

A further embodiment of the present invention comprises allowing a player to initiate a betting round by placing an initial bet, and disqualifying remaining players who do not at least match the initial bet. After a player places an initial bet, the remaining players have the option of matching the initial bet (calling), increasing the bet (raising or placing a raised bet), or declining the match the bet and becoming disqualified for the remainder of the betting event (folding). Each remaining player is given a finite amount of time to at least match the initial bet before being disqualified. Disqualified players cannot be winners of bets placed during the betting rounds for that betting event. Where a player responds to a bet by placing a raised bet, the remaining players must at least match the total amount of the raised bet or be disqualified. Similar to traditional poker, a player may respond to a raised bet by placing an additional raised bet. Failure to pay an ante or to at least match a bet made by another player is similar to folding in a traditional poker game. In one embodiment, remaining players, i.e. players who have not been disqualified, can initiate a betting round at any time during a betting event by placing an initial bet. In another embodiment, remaining players can initiate a betting round at any time during a betting event, with the exception that a player cannot institute a new betting round if that same player initiated the previous betting round. Optionally, remaining players can initiate a betting round at any time during a betting event, with the additional exception that a player cannot institute a new betting round if that same player placed the last raise in the previous betting round. The number and order of betting rounds are not predetermined in this embodiment as they are in traditional poker games. Conceivably, a betting event could have as many betting rounds as can be permitted within the time frame allowed by the betting event as long as two or more players are willing to continue betting.

In another embodiment, the present invention provides a system for providing a betting game between a plurality of players, wherein the betting game is based on a live event comprising one or more betting events, and where the system comprises a host processor programmed for analyzing and processing input data, and outputting data and information relevant to the betting game. The host processor is programmed to: provide a deck of cards, wherein each card has a value determined by actions occurring during the one or more betting events; distribute one or more cards from said deck to each player before or during a first betting event, wherein the value of the distributed cards are able to change during the course of the first betting event; monitor the live event until a termination event occurs with regard to the first betting event; provide one or more betting rounds during the first betting event until the termination event occurs, wherein during the betting rounds the plurality of players are allowed to place bets on the value of the cards distributed to the players; upon termination of the first betting event, determine a final value of the distributed cards for the terminated betting event and paying winners of bets placed during the betting rounds based on the final value of the cards, wherein the bets are placed using chips or tokens and wherein the chips, tokens and cards are electronic units. The system also comprises a plurality of player processors interactively connected to the host processor, where the player processor is able to send and receive data to the host processor. The system also comprises a display and interface device operatively associated with each player processor, where the display and interface device is able to display data received from the player processors, and is able to send betting instructions entered by a player to the host processor through the player processor.

While poker-like games and in-game sports betting are separately known in the art, it is believed that no poker or poker-like game has been devised that combines both a poker-like game with in-game sports betting. In particular, it is believed that no previous poker-like game incorporates any of the following characteristics of the present invention:

Cards Whose Values are not Known with Certainty Until the Round is Over.

With a traditional deck of cards, the values of the cards are specified by their identities, and they do not change; i.e., a Queen of Hearts is always a Queen of Hearts, so the value of a hand is completely and solely determined by the cards in it. In the present invention, the value of a card depends on an external event, e.g., a live sporting event, whose outcomes cannot be known with certainty until the event is over. For example, where the betting event is a drive in a football game, a quarterback card in a certain embodiment can have a value equal to the total number of yards passing by the quarterback during a given drive, plus additional points for each first down passing during the drive, plus additional points if the drive ends with a touchdown pass. Before and during the drive, the precise value of the quarterback card cannot be known with certainty, although its likely value gradually comes into focus as the drive progresses. When the drive is over and the betting event has terminated, the card's value is known exactly. The precise nature of the cards used in the present invention will be elaborated on below.

Rounds that Depend on (and Cannot be Properly Played without) the Action in a Live Sporting Event.

The preferred embodiment of the present invention is played during a live sporting event, which the players are watching while they play. The values of the cards used in a round of the present invention are determined by the events in the live sporting event. Since the outcome of a live sporting event is not known in advance, the values of the cards are not known when they are dealt to the players, and can only be estimated during the round. Since the uncertain values of the cards are an integral part of the present invention, the present invention cannot be played without a live sporting event (or some other event with an unknown outcome, like an election, a stock price, or episode of a reality TV show). Since traditional poker is a self-contained game, the present invention, which requires an external "random event" is quite different from traditional poker at a fundamental level.

Asynchronous and Unstructured Betting.

In traditional poker, players take turns making bets, raises, calls, and folds, during a betting round in a set order around a table (real or virtual). The (potential) betting rounds occur at certain specified times during the round, e.g., after the "hole cards", after the "flop", after the "turn", and after the "river", in Texas Hold'em. In the present invention, betting rounds are initiated by players, at the times of their choosing, and not by house rules. Optionally, the betting in the present invention is subject to predetermined rules, such as the same player cannot initiate two consecutive betting rounds, or time limits when bets can be made. A display signal, such as a red or green betting light, can be used to indicate when bets are allowed to be made or cannot be made.

Once a betting round begins, the remaining players must call a bet within a given time interval or they are "out" of the round. The players act independently during betting rounds, so there is no fixed order that the players make their plays. The flow of the play of the present invention is therefore quite different from traditional poker: there is no predetermined number of betting rounds, no predetermined times for the betting rounds, and no fixed order of events within the betting rounds.

In one embodiment of the invention, a betting game based on a live sporting event, also referred to herein as a Sports Poker game, is provided over the internet at a web site, for the purpose of playing rounds of the Sports Poker game during the sequence of pre-specified betting events that will occur during a pre-specified live sporting event. Players login to the web site from their homes or other convenient locations before the live televised sporting event begins, and choose a virtual table to play at. Players can then watch the live broadcast of the sporting event wherever a TV is available, such as from home. During the live sporting event a round of Sports Poker is played during each betting event within said sequence of betting events during the live sporting event. For example, during a live football game there may be a round of Sports Poker during each drive in the game. In a live baseball game, there may be a round of Sports Poker during each inning in the game. In a tennis match, there may be a round of Sports Poker during each set. The betting rules and decks of cards may be different at different tables. The object of this embodiment is for a player to accumulate as many chips as possible in the betting rounds during the live sporting event.

In another embodiment of the invention, a web site offers Sports Poker games corresponding to a plurality of betting events and/or sporting events simultaneously. This is possible, for example, when there are several live sporting events occurring at the same time. Each table on the web site provides a (possibly different) Sports Poker game that players can choose to play after they log on.

In another embodiment of the invention, players choose a table at a casino to play rounds of a Sports Poker game during a live sporting event, which the players can watch on a television screen while they play. In this embodiment, the Sports Poker game uses a human dealer and a physical deck of cards at each physical table. The betting rules and decks of cards may be different at each table. If the televisions in the casino show more than one live sporting event, then different tables may feature a Sports Poker game based on the different live sporting events. The object of this embodiment is for a player to accumulate as many chips as possible during the course of the live sporting event.

In another embodiment of the invention, players may change tables and play against different opponents in each round. This embodiment can be a virtual (online) game or a physical game played in a sports bar or casino. In this embodiment, every table plays the same version of the Sports Poker game; i.e., they use the same deck of cards for the same betting events within the same live sporting event, and play by the same house betting rules. The object of this embodiment is for a player to accumulate more chips than all the other players during the course of the live sporting event. The winning player wins a grand prize. This embodiment is ideal for big sporting events like the Super Bowl, a World Series game, or a Grand Slam tennis final match.

In another embodiment of the invention, players compete in a tournament, which comprises one or more rounds, each round based on betting events within a different live sporting event. The live sporting events comprising the rounds of the tournaments cannot temporally overlap each other. The winner at each table in each round moves on to the next round, based on who has the most chips at that table at the end of the corresponding live sporting event. The last round of the tournament takes place at a single table. For example, a tournament could be organized where the first round takes place during the early Sunday afternoon NFL games, the second round during the late Sunday NFL games, and the final round during the Monday night game.

In every embodiment of the present invention, the betting game requires traditional poker skills (when and how to bet, bluff or fold), as well as sports knowledge to judge the values of the cards based on the action in the live sporting event.

BRIEF DESCRIPTIONS OF THE DRAWINGS

FIGS. 6A-6B show a sample deck of cards for a betting game of the present invention where the betting event is a drive during a live football game.

FIGS. 7A-7D show a sample deck of cards for a betting game of the present invention where the betting event is a half of an inning during a live baseball game.

DETAILED DESCRIPTION OF THE INVENTION

Definitions

Figure 1:
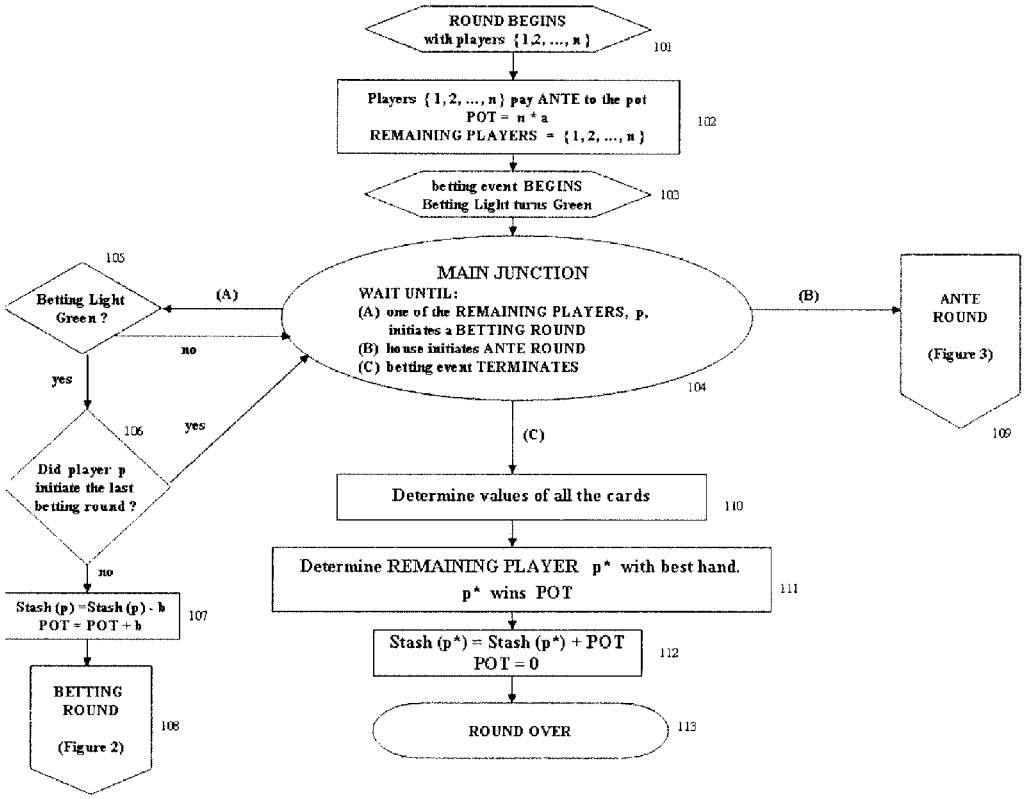
FIG. 1 is a flow diagram for a round of a betting game of the present invention. The part of the flow diagram corresponding to betting rounds and ante rounds are detailed in FIGS. 2 and 3.

As used to describe the present invention, the following terms are defined as follows.

"Sports Poker" is the generic name used for a betting game of the present invention where the live event is a live sporting event.

The "house" is the generic name for the person or entity administering the betting game of the present invention. The house may be a bricks and mortar casino or business, or may a web site on the internet.

The "house rules" of a round specify the precise rules and way the round of a betting game of the present invention is played. An example of house rules for a betting game is detailed below. House rules fill in any details that general rules of the betting game do not specify or specific modifications instituted by the house.

A "sporting event" is an athletic contest of some sort, including but not limited to a football game, baseball game, basketball game, hockey game, tennis match, golf tournament, race, Olympic event, boxing match, martial art fight, and wrestling match. A "live event" refers to a sporting event or any other unpredictable event that that proceeds over time with an unambiguous beginning and end, including but not limited to an election, a stock price during some period of time, awards show, and an episode of a reality television show.

A "live sporting event" is a sporting event that is occurring in the present. Additionally, a live sporting event can include a prerecorded sporting event where the players do not know anything about the outcome or events that took place during the event.

A "betting event" is any part of a live sporting event with an unambiguous beginning and end. For example, in a football game, each drive is a possible betting event, as is each set of downs, half and each quarter. The entire game can also be a betting event. In baseball, an at bat is a possible betting event, as is an inning, a half inning and the entire game. In tennis, a game, set and match are possible betting events.

A "player" is someone who is participating in a round of a betting game of the present invention. The players sit at "tables" (real or virtual). Players at the same table are in competition with each other.

A "round of a betting game" is a period of a betting game that begins when (or just before) a betting event starts, and ends when the betting event terminates.

An "athlete" is a participant or member of a teams playing in the live sporting event.

The "outcome" or "actions" occurring during a betting event is a set of statistics and other descriptors that summarize all relevant aspects of the betting event. For example, in a drive betting event in a football game, the statistics for each athlete during the drive is part of the outcome, as is the number of $3^{rd}$ down conversions, whether or not there was a fumble, and whether or not the drive ended in a touchdown. The outcome of a betting event is not known completely and with certainty until the betting event terminates.

A "card" is a token, physical or virtual, representing an athlete or some aspect or contingency of a betting event. The value of a card can be unambiguously determined from the final outcome of the betting event. For example, if the betting event is a drive in a football game, then in one embodiment of the present invention, a touchdown card is worth a specified amount of points if the drive ends in a touchdown, and no points otherwise, and a quarterback card is worth a specified amount of points for each yard passing by the quarterback during the drive. Before termination, the values of the cards can only be approximated.

A "deck of cards" is a collection of cards that is used to play rounds of the betting game. A deck of cards is designed specifically for a given betting event in a given live event. There can be many different decks of cards associated with a given betting event. FIG. 6 illustrates an embodiment of a deck of cards for a round of Sports Poker based on a drive within a football game. FIG. 7 illustrates an embodiment of a deck of cards for a round of Sports Poker based on a half-inning within a baseball game. Players at the same table use the same deck of cards A "hand" is a subset of the deck of cards that a player possesses during a round of the betting game.

A player is "in" a round of a betting game of the present invention if the player has not been disqualified and is still in contention for winning the round. A player that is no longer in the round is "out" or "disqualified".

The "remaining players" in a round are those players that are still in.

A "chip" or "token" is a generic unit of currency for the betting game of the present invention. Antes, bets, raises and calls, are paid to the pot in units of money, chips or tokens.

The "pot" is the collection of chips paid by the players during a round of the betting game of the present invention in the form of antes, bets, raises and calls.

A player's "stash of chips" are the chips or tokens that is owned by the player and are available for future antes, bets, raises and calls. A player's stash of chips does not include chips that have already been paid to the pot during the current round. The player's stash of chips increases by the amount in the pot when the current round of the betting game ends, if the player wins that round.

An "ante" is a mandatory contribution to the pot that each player must pay, at certain times specified by the house rules, if the player wants to stay in the round. Players that do not pay their ante within the allotted time, also set by the house rules, are disqualified.

A "bet" is a voluntary donation to the pot by one of the remaining players. When a bet is made, a "betting round" begins which requires all other remaining players to match the initial bet (call), raise the bet, or be disqualified (fold). A betting round ends some time after it begins, according to the house rules.

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

OVERVIEW

The betting game of the present invention is played while watching (or otherwise monitoring) a live event, preferably a sporting event. The live event contains one or more betting events having an unambiguous beginning and end; such as a drive in a football game, a set in a tennis match, or an inning in a baseball game. The betting game distributes cards to a plurality of players where the value of the cards are determined by the actions and outcomes of the betting event. The players are allowed to bet on their hand during the betting event similar to betting in a traditional poker game knowing that the value of their hand and their opponent's hand can change during the course of the betting event.

A physical realization of a round of Sports Poker would typically take place in a casino or sports bar, while a virtual realization of Sports Poker would typically involve players that play from home, over the internet. This is analogous to present ways that traditional poker is played.

Rounds of Sports Poker of the present invention are played in a physical or virtual environment that typically includes the following items:

1) A table for the players to "sit and play". The players do not change positions at the table during a round of Sports Poker.
2) A television set visible to each player, tuned into the live sporting event that the rounds of Sports Poker are based on. (There are other ways that players can closely monitor the live sporting event besides a live television broadcast. They could be getting live play by play over the internet, or they could even be a spectator at the sporting event itself.)
3) A deck of cards specifically designed for the sporting event and betting event that the rounds of Sports Poker are based on.
4) A betting light, which can be red or green, that indicates to the players when a bet can be placed. Any binary switch can serve as a betting light, but red and green lights are ideal because of their obvious analogy to traffic signals.

5) A clock (digital or analog) that counts down the remaining time in betting rounds and ante rounds.

The house is responsible for choosing the deck of cards to be used, as well as controlling the betting light and the clock. The house also supplies a "dealer" (real or virtual) that performs the tasks that a traditional poker dealer is responsible for, such as dealing and shuffling cards, and enforcing the rules.

An instance of Sports Poker of the present invention is called a "round of Sports Poker" or a "game round". A round of Sports Poker is played during a betting event that occurs during a sporting event. A round of Sports Poker has many similarities to a round of traditional poker:

1) Players contribute antes to the pot at the beginning of a round;

2) Cards are dealt to the players during the round according to strict rules;

3) Players can make bets based on the quality of their hands (including bluffs); and 4) The remaining player at the end of the round with the best hand wins the pot.

However, the betting rounds in Sports Poker of the present invention follow different rules than betting rounds in traditional poker. In fact, the betting rounds in Sports Poker follow different rules than any betting game known in the art. Also, the cards used in the betting game of the present invention are of a very different sort from the cards used in traditional poker, and different from the kinds of cards used in every other card or betting game known in the art. The kinds of cards used in Sports Poker and other betting games of the present invention are of crucial importance.

In the present invention, a "card" is a token, physical or virtual, representing an athlete or some other aspect or contingency of a betting event. FIG. 6 illustrates a possible embodiment of a deck of cards for rounds of Sports Poker based on the drives in a football game, and FIG. 7 illustrates a possible embodiment of a deck of cards for rounds of Sports Poker based on half-innings in a baseball game.

The "value" of a card can be unambiguously determined when the betting event ends, but not before. For example, as illustrated in FIGS. 6A and 6B, if the betting event is a "drive" in a football game, then the "touchdown card" 606 is worth 25 points if the drive ends in a touchdown, and 0 points otherwise. The "quarterback card" 601 is worth 1 point for each yard passing by the quarterback during the drive, plus 5 points for each first down by passing during the drive, plus 10 points if the quarterback throws a touchdown pass. Before the drive ends, the values of the cards are uncertain. Nevertheless, the players can estimate the likely values of their cards during the round of Sports Poker since they are watching the betting event on TV, and in this way they can estimate the changing values of their hands during the round. As the betting event proceeds, the values of the cards gradually come into better focus, and the values are known exactly when the drive ends.

To illustrate the possible dynamics of the value of a card during a round of Sports Poker, consider a drive that begins on the driving team's 20 yard line, and ends in a missed field goal from the opponent's 20 yard line. The "punt card" 608, which is worth 10 points if (and only if) the drive ends with a punt, is a good card when the drive begins, but looses value as the drive progresses. In the end, the "punt card" has no value at all. The "field goal card" 607, which is worth 10 points if (and only if) the drive ends with a successful field goal, has some value when the drive begins, since field goals are common outcomes of drives starting from every part of the field. However, the value of the "field goal card" goes way up when the drive sputters out within field goal range, but in the present example, the "field goal card" ends up with no value. During most of the drive, the "XFG card" 609 (missed field goal card), which is worth 30 points if (and only if) the drive ends with a missed field goal, had low value since missed field goals are fairly uncommon. The value of the "missed field goal card" in the present example probably had its maximum when the ball was in long field goal range (e.g., the opponent's 35 yard line), and then dropped considerably after that. Of course, in the present example a "XFG card" ended up being worth 30 points, because that was, in fact, the outcome of the drive. The "quarterback card" 601 typically grows in value as the drive progresses, so quarterback cards are good in long drives. In the present example, some or all of the "player cards" (e.g., QB 601, RB 602, WR 603) must have been valuable in the end since the drive covered 60 yards. In a short drive, the player cards have little or no value, and the punt card 608, D card 605 (Defense), and 3-and-out cards 614 have the most value. A player with a 3-and-out or punt card may be wise to bet early in the drive, to try to convince some of the players to fold, since those cards will be worthless if the drive is long. Of course, a bet early in the drive may be a player bluffing that he has a 3-and-out card and/or a punt card. The values of the cards in the deck vary as the drives unfold, and the final values of the cards in the deck are different in each round of Sports Poker.

In a Sports Poker game of the present invention the cards are dealt from a deck of cards, which is chosen by the house, and which is designed for the particular sporting event and betting event that the rounds of Sports Poker are based on. Cards are dealt to the players during the round of Sports Poker according to strict rules which are determined by the house, and which are designed for the particular sporting event and betting event that the rounds of Sports Poker are based on. Likewise, the timings of the ante or antes during a round of Sports Poker follow strict rules which are determined by the house, and which are designed for the particular sporting event and betting event that the rounds of Sports Poker are based on. Likewise, the allowable sizes of bets during the rounds of Sports Poker follow strict rules which are chosen by the house, and which are designed for the particular sporting event and betting event that the rounds of Sports Poker are based on. The house also sets rules that specify when the betting light is red and when it is green, i.e. when players can place bets. The house administers the game of Sports Poker, at an internet web site, or at a sports bar or casino, so the players can engage in rounds of Sports Poker.

In one embodiment of a Sports Poker game of the present invention, a betting round is initiated by a player, who is still "in" the round, and not by the house. The betting round is initiated at the time of said player's choosing, subject to the two simple rules: the "betting light" must be "green" (there is no betting allowed when the betting light is "red"), and said player did not initiate the previous betting round. When a player initiates a betting round in Sports Poker, the other remaining players at the time of the bet must "call" the bet in order to remain "in".

In one embodiment of Sports Poker, a timer starts when the betting round starts, and each of the remaining players (besides the player that initiated the betting round) must call the bet before the timer runs down, or they are out. When a player initiates a betting round, the house provides a way for the other players to be immediately aware of said fact. In a casino or sports bar there are physical cards and chips so it is apparent when a bet is made, and it is apparent which player made the bet. A physical clock may then start counting down the allotted time for the other players to call the bet. If the house provides the rounds of Sports Poker over the internet, then some analogous mechanism must be in place. For example, player screens displayed by a computer may show the virtual table with virtual chairs corresponding to the players. When a player makes a bet, his virtual chair may start flashing, which shows the other players that he made a bet. At this same time, a virtual clock would count down the allotted time for the other players to call the bet.

EXAMPLES

Example 1

Basic Game Logic

FIG. 1 shows the basic logic of a round of a Sports Poker game. The round begins 101 with n players {1, 2, . . . , n} who pay an ante 102 of a chips to the pot 403 (shown in FIG. 4) so the pot has n*a chips. By paying their ante, the n players are all in. The betting event begins and the betting lights on the players' screens 409 (FIG. 4) turn green 103, so players are allowed to bet.

At the Main Junction 104, the process waits until one of three events occurs:

1) One of the remaining players, denoted p, attempts to make a bet. If the betting light is not green 105 then the attempt is rejected and the process returns to the Main Junction 104. If the light is green then it must be determined if player p initiated the previous betting round 106. If he did, then he is not allowed to initiate one at this time, so his attempt to bet is rejected, and the process returns to the Main Junction 104. If player p did not initiate the previous betting round then the bet is accepted 107, and b chips are moved from player p's stash to the pot, thereby initiating a betting round 108. When the betting round is complete the process returns to the Main Junction 104.
2) The house initiates an ante round 109. When the ante round is complete the process returns to the Main Junction 104.
3) The betting event terminates. At this point the values of all the cards can be determined exactly 110, and therefore the values of all the hands can be determined exactly 111. The remaining player with the best hand, denoted p*, wins the pot. Player p* has his stash of chips increased by the amount of the pot, the pot is reset to zero 112, and the round of Sports Poker is over 113.

Figure 2:
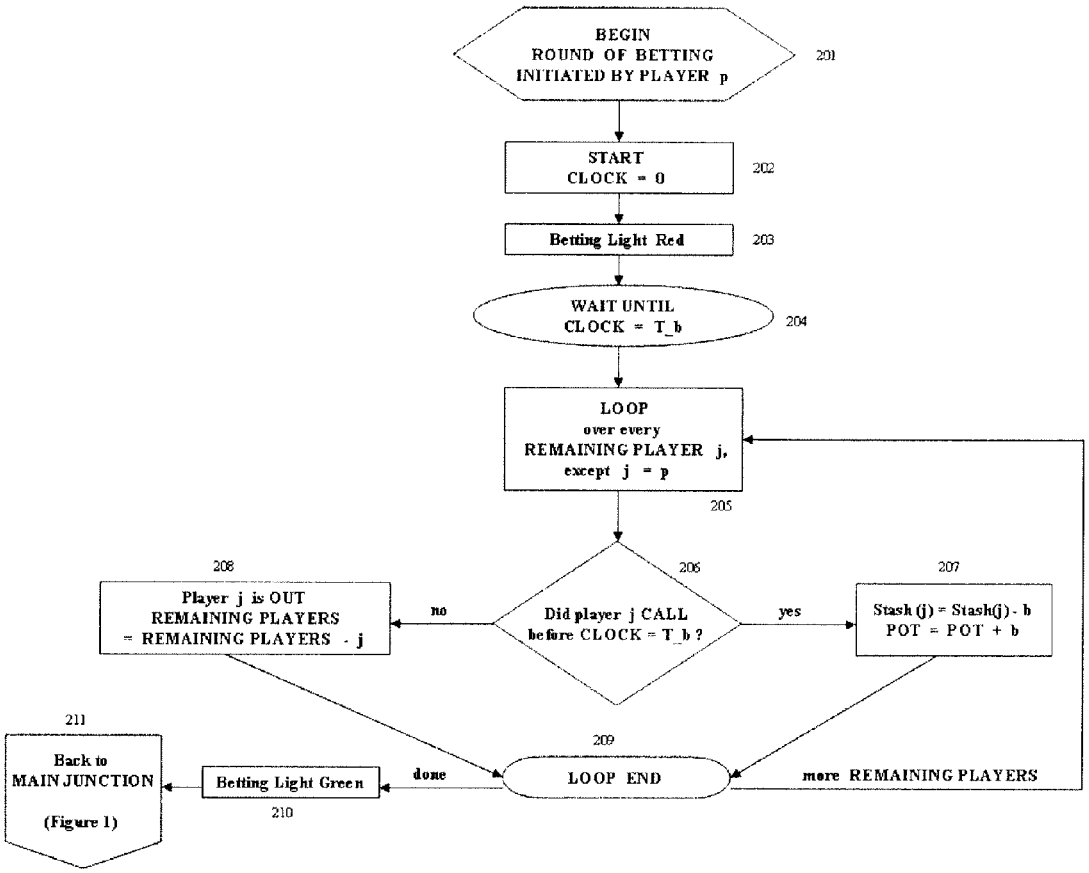
FIG. 2 is a flow diagram for a betting round initiated by one of the remaining players in a round of a betting game of the present invention. This portion of the round starts when a betting round is successfully initiated by one of the players (choice (A) in the MAIN JUNCTION shown in FIG. 1), and ends when the betting round is complete.
Figure 4:
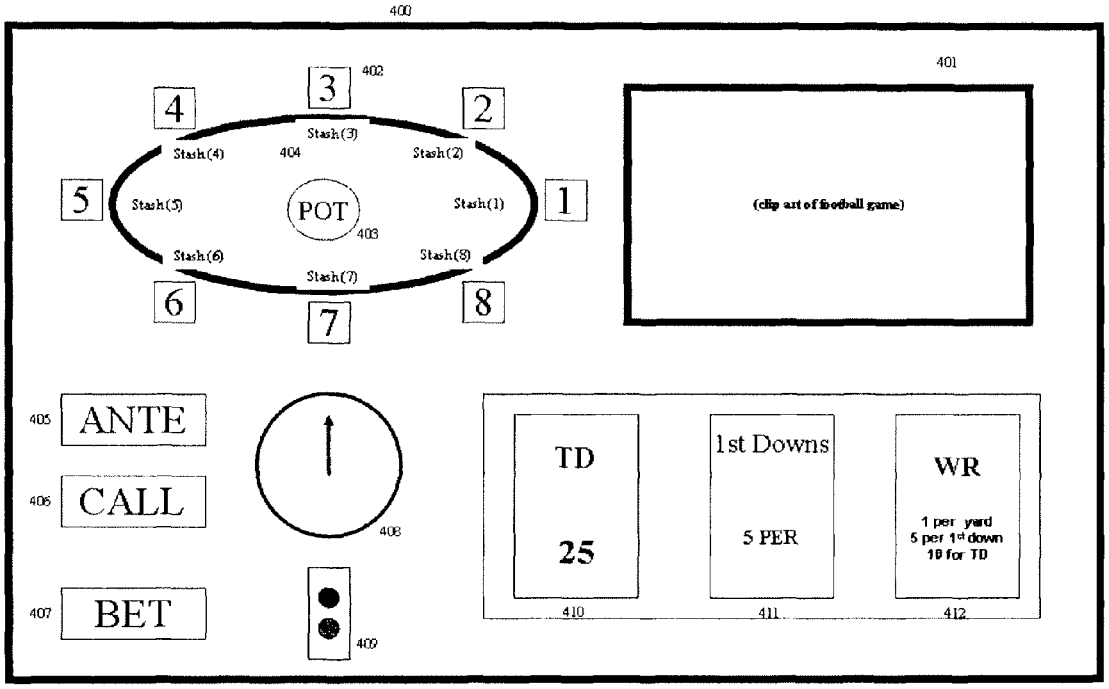
FIG. 4 shows a functional "player screen" for a betting game of the present invention provided over a computer network.

FIG. 2 shows the basic logic of a betting round in a round of a Sports Poker game. A betting round is initiated by a player, denoted p, step 108 in FIG. 1, and 201 in FIG. 2. The clocks on the players' screens 408 are set to "zero" 202 and the betting lights on the players' screens 409 (FIG. 4) are turned to red 203. The chair 402 (FIG. 4) belonging to player p begins to flash on all the players' screens, so all the players know who initiated the betting round. Between time zero and time T_b, the players decide if they want to call the bet or not. Those players that decide to call the bet must click their call button 406 before the clock 408 reaches T_b (FIG. 4). Those players that do not call in the allotted time are out. When the clocks 408 reach T_b 204, player p's chair 402 stops flashing, and the house considers each of the remaining players, except player p, to determine whether or not they called the bet 206. If a player did call the bet 207 then b chips are moved from said player's stash 404 to the pot 403, and that player is still in. If a player did not call the bet then he is out 208. When the status of the remaining players is determined, the betting round ends 209, the betting lights 409 turn green 210, and the process returns to the Main Junction 104.

Figure 3:
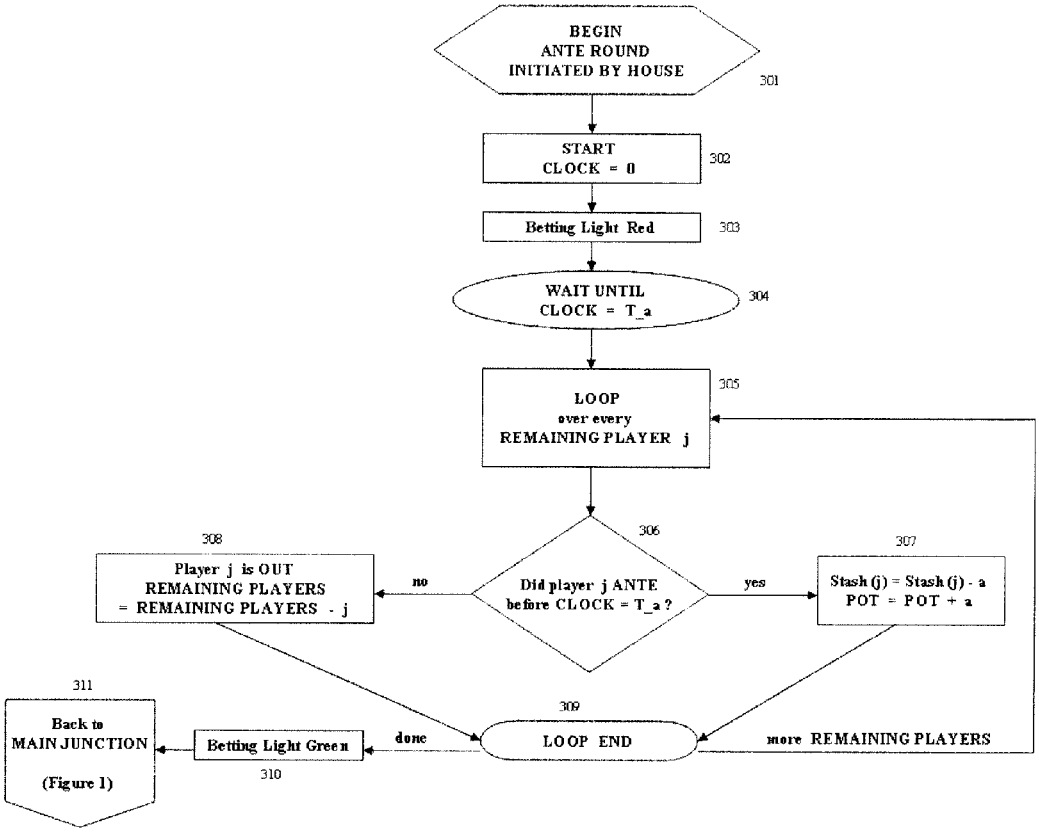
FIG. 3 is a flow diagram for an ante round initiated by the house in a round of a betting game of the present invention. This portion of the round of starts when the house initiates a round of antes (choice (B) in the MAIN JUNCTION shown in FIG. 1), and ends when the ante round is complete.
Figure 5:
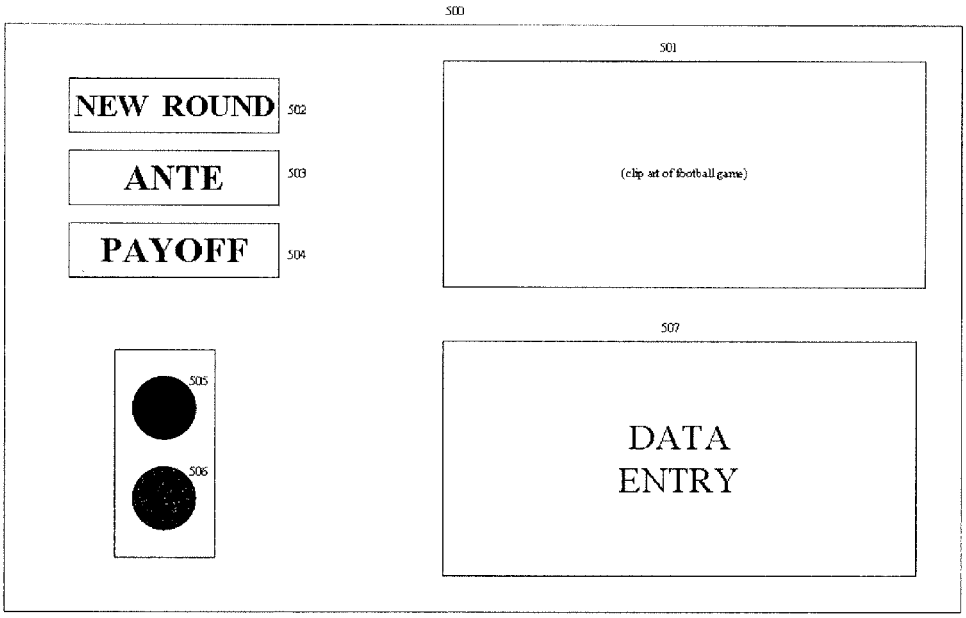
FIG. 5 shows a functional "house screen" for administering a betting game of the present invention provided over a computer network.

FIG. 3 shows the basic logic of an ante round in a Sports Poker game. An ante round is initiated by the house 109 in FIG. 1, and 301 in FIG. 3 by clicking the ante button on the house screen 503 (FIG. 5). The clocks on the players' screens 408 are set to zero 302 and the betting lights on the players' screens are turned to red 303. The clocks 408 begin to move and the ante button on the players' screens 405 begin to flash, so the players know that an ante round has begun. Between time zero and time T_a, the players decide if they want to pay the ante or not. Those players that want to stay in must pay their ante by clicking their ante button 405 before the clock 408 reaches T_a, in which case a chips are moved from their stash of chips 404 to the pot 403. The players that do not ante in time are out. When the clocks 408 reach T_a 304, the ante buttons 405 stop flashing, and the house considers each of the remaining players to determine if they paid their ante 306. If a player did pay his ante 307 then a chips are moved from said player's stash 404 to the pot 403, and that player is still in. If a player did not pay the ante then he is out 308. When the status of the remaining players is determined, the ante round ends 309, the betting lights 409 turn green 310, and the process returns to the Main Junction 104.

Example 2

Player Screens and House Screens for Games Provided Over the Internet

FIG. 4 shows a possible player screen for a Sports Poker game played over the internet. There are only three actions that a player can make in a round of Sports Poker, which are ante, call, and bet. Clicking the ante button 405, call button 406, and bet button 407, is how the players initiate those actions. Players need to know who they are playing against, how many chips their opponents have in their stashes, how many chips they have in their own stash, the size of the pot, who initiates the betting rounds, when the betting rounds start and how much time is left in them, when the ante rounds start and how much time is left in them, whether or not they are allowed to bet, and which cards they have in their hands. The player screens display all this information. The players are represented by their chairs 402, and their stashes of chips 404 are displayed on the table in front of them. The pot 403 is displayed in the middle of the table. When a player initiates a betting round, said player's chair 402 begins to flash, and the clock 408 starts to run from zero to T_b. When an ante round is in progress the players' ante button 405 flashes and the clock 408 runs from zero to T_a. The cards in a player's hand 410, 411, 412 are displayed to said player, and none of the other players. The betting light 409 is displays either the red light on or the green light on, depending on whether or not the player is allowed to bet. There may also be a video of the live sporting event 401 so the player can watch as he plays, but this is not necessary for a player screen since the player can also watch the live sporting event on television.

FIG. 5 shows a possible house screen for a Sports Poker game. The house is responsible of initiating the ante rounds, controlling the betting lights 409 on the player screens, and determining the exact values of the players' hands at the end of the round. There may be a video of the live sporting event 501 so the house administrator for Sports Poker can watch as he administers the game, but it is not necessary since the house Sports Poker administrator can watch the live sporting event on television. The house screen has a red button 505 and a green button 506 which are used to change the color of the betting lights 409 on the player screens. Normally the betting lights are green, but there are certain times (like during plays in a football game) when the house might choose to turn the betting lights red. The betting lights are also red during betting rounds and ante rounds, but the Sports Poker system can take care of that automatically. The house screen may also have a button to start a new round 502, which would alert players on their screens by (for example) flashing the ante button 405. The house screen may also have a button that pays off the winning player 504 when a round ends, causing the pot 403 to move over to the winning player's stash 404. The house screen may also have a method for the Sports Poker administrator to input data 507 as the betting event unfolds so as to automatically calculate the values of the cards at the end of the round.

Example 3

Card Examples for Various Betting Events

FIGS. 6A and 6B show a possible deck of cards (items 601-624) for a round of a Sports Poker game that is played during each drive in a football game. This version of Sports Poker can be called DrivePoker to signify the type of betting event involved. The values of every card in the deck can be unambiguously determined when the drive is over, but is in some doubt until that point in time. The values of the cards typically change between drives since no two drives are exactly the same. For example the QB card 601 is worth 1 point for every passing yard by the quarterback during the drive, plus 5 points for each passing $1^{st}$ down, and an additional 10 points if he throws a TD pass. At the beginning of a drive the QB card is worth 0 points, but the total typically increases as the drive proceeds. A skilled player will be able to predict better and better estimates of the final value of the card as the drive proceeds. The RB card 602 (running back), WR card 603 (wide receiver), TE card 604 (tight end), and D card 605 (defense) are similar to the QB card 601 since they depend entirely on the statistics of the players during the drive. The cards 601, 602, 603, 604, and 605 are called "player cards". The TD card 606 is a different type of card. It is worth 25 points if the drive ends in a touchdown, and 0 points otherwise. Although the TD card can attain only two possible values, its "expected value", which is a measure of its likelihood of occurring, can change continuously between the two values. A skillful player will accurately estimate the probability of the drive ending in a touchdown, and thereby accurately estimate the current value of the card. The FG card 607, PUNT card 608, XFG card 609 (missed field goal), TurnOver card 610, Fumble card 611, INT card 612 (interception), 3&Out card 614, OfficialReview 615, BigPlay 619, 2 Point Conversion 620 and Clock 623 are similar to the TD card 606 since their values depend on whether or not a particular event or outcome occurs in the drive. These are called "event cards". The remaining cards in the DrivePoker deck $1^{st}$ Downs 613, Sacks 616, Penalties 617, LongGain 618, $3^{rd}$ Down Conversion 621, $4^{th}$ Down Conversion, and Time Out 624, have values that are determined by the number of times some event occurs in the drive. For example, the Sacks card 616 is worth 20 points per sack during the drive. Cards like this are called "per event cards". A good deck of cards for a Sports Poker game can be designed using a combination of player cards, event cards, and per event cards. It is sometimes possible to design a card that does not fit into any of the three categories; for example, a card that is worth 10 points no matter what happens in the drive. A deck can contain multiple copies of a given card. There are many possible decks of cards that could be designed for a given version of Sports Poker. In particular there are many possible decks of cards for DrivePoker, and the example in FIGS. 6A and 6B is just one of them.

FIGS. 7A-7D show a possible deck of cards (items 701-748) for a round of a Sports Poker game played during a half-inning of a baseball game. This version of Sports Poker will be called InningPoker to signify the type of betting event involved. In this example the player cards can have the names of the players, and not just their generic positions (as was the case for the DrivePoker cards in FIGS. 6A and 6B), so one can see that the InningPoker cards in FIGS. 7A-7D are designed for a game played between Boston and New York. In this deck, the player cards accumulate (or lose) points for offensive and defensive plays, so the same deck can be used for the top and bottom of each inning, as long as the players on the field don't change. The house would have cards corresponding to other players on the teams in case a substitution is made. For example, the Boston Center Fielder card 701 depends on how he performs during the half-inning. His card is worth 5 points per at-bat, plus 10 points if he gets on base, plus 5 points per base per hit (i.e., a single is worth 5 points, a double is worth 10 points, a triple is worth 15 points, and a home run is worth 20 points), plus 5 points for each RBI, plus 10 points per run scored, plus 10 points per stolen base, plus 5 points per put out, plus 30 points for an assist, minus 10 points per error. Notice that offensive and defensive statistics count towards the final value of the card, so the card can be used in the top and bottom of each inning. The player cards 701-724 are similar since their value depends on how the athlete featured on the card performs during the half-inning. However, the details of how the values of the player cards are determined differ to account for the fact that they play different positions on the field. The remaining InningPoker cards 725-748 are various event and per event cards corresponding to things that may or may not occur during a typical half-inning of a baseball game.

Example 4

A Hypothetical Round of a Sports Poker Game

Perhaps the best way to explain how a Sports Poker game works is to narrate a hypothetical round. For this example the drive betting event within a football game is described, using a deck of cards made from the cards shown in FIGS. 6A and 6B. (There may be more than one copy of each card in the deck.) Hereafter, the term DrivePoker will denote the particular version of a Sports Poker game that is described presently.

A round of DrivePoker is played during each drive of a football game. A typical football game has about 15-20 drives, and a round of DrivePoker can potentially be played in every one of those drives. In the present example, there are eight players, who each play at their home on their laptop computer, which is connected to a Sports Poker web site over the internet. The players have their laptop computers in front of them as they watch a live New England vs. Denver game on their television. The present hypothetical round of DrivePoker will be based on a hypothetical drive within the hypothetical New England vs. Denver game. The round of DrivePoker takes place at a "table" with players, "Player A", "Player B", and six other players (Players 3 through 8). The precise house rules (when and how many cards are dealt, allowable bet sizes, timings of the ante rounds, determination of the best hand) are described as part of this narration.

The Denver team has just punted, and the New England team receives the ball on their own 16-yard line. A new drive is about to start (after the TV commercial) so a new round of DrivePoker begins. The players pay an ante of 5 chips to the pot before the commercial ends. They pay by clicking the ante button 405 on their player screen, FIG. 4. Everybody pays their ante, so the pot 403 has 8×5=40 chips.

In the present example, when players pay their ante they get two cards. Additional cards will be dealt to the players (that are still in) after each first down—up to a maximum of 5 cards. The value of the hand is determined by the sum of the point values of the two best cards. Bet sizes are 5 chips for each card in the players' hands, so bets start at 10 chips and increase as the drive progresses up to a maximum of 25.

In this example, Player A was dealt a TD (touchdown) card 606 and a WR (wide receiver) card. 603. The New England team has a powerful air attack with their respective quarterback and wide receiver, so a WR card is potentially a very good card (at least 1 point per yard gained). New England also has a good offense, so a TD card is always good (25 points for a touchdown). Of course at the 16-yard line even a good football team is not favored to score a touchdown, but if the drive gets off to a good start, the card will quickly increase in value. Of course, if the drive does not end in a TD, the card is worth nothing.

Player B's two cards are XFG (missed field goal) 609 and 3$^{rd}$ Down Conversion 621. The XFG card is worth 30 points if the drive ends with a missed field goal, but it is worth nothing otherwise, so initially this card is not a very good card. The 3$^{rd}$ Down Conversion card is worth 5 points for each 3$^{rd}$ down conversion in the drive, so it's usually a good card on a long drive.

The house (i.e., the SportsPoker web site administrators) controls the betting lights on the player screens 409, with their controlling mechanism 505, 506, so that it is green during huddles, time outs, and other breaks in the action, and it is red during the action on the field. The betting light 409 is presently green, so any player that wants to make a bet can. In this Sports Poker game, any player that is in, can place a bet whenever he or she pleases, as long as the green light is on, and as long as that player did not make the previous bet. When the round starts, any player can make the first bet. In the present example, none of the players make an immediate bet. The commercial ends and the teams line up for the first play of the drive. The betting light on the players screens 409 turns red, meaning that nobody can bet until it turns green again (no bets during the play). The ball is snapped, the quarterback hands the ball off to a running back, but the Denver defense tackles him for a 2-yard loss.

The betting light 409 turns green as the teams go into a huddle. A few seconds later Olayer 3 402 makes a bet. Perhaps that player has a 3&out Card 614, which has just gone up in probable value after the loss on 1$^{st}$ down.

A player makes a bet by clicking the bet button 407 on his player screen, FIG. 4. This act automatically pays the right amount to the pot 403, from his stash of chips 404, and starts a betting round. The virtual chair 402 corresponding to the player that made the bet changes color and flashes on and off, so the other players know a bet was made, and by whom. From that instant in time, the players that are still in have 15 seconds to decide whether to call or not (i.e. T_b=15 seconds). The clock 408 sets to 15 seconds and starts winding down. If a player clicks the call button 406 before the clock 408 runs down, the bet is matched (an amount equal to the amount bet is transferred from the player's stash to the pot), and he is still in. If a player does not click the call button before the clock winds down, he has automatically folded and is out of the round. There is no set order around the table for bets and calls. Each player is on his own, subject to the rules just mentioned. The Sports Poker web site software takes care of all the accounting tasks that a traditional poker dealer would do, such moving chips from the players stash to the pot, paying off winners, etc. The Sports Poker web site software also deals the cards, and the Sports Poker web site software will not allow the same player to initiate two consecutive betting rounds Otherwise, the players are in complete control of the flow of the round of Sports Poker.

In the present hypothetical game, everybody calls the early bet by Player 3 and awaits the next play. The pot now has an additional 8×10=80 chips, for a total of 120 chips. Player 3 cannot make the next bet since it is a rule of this Sports Poker game that a player cannot initiate two betting rounds consecutively, but any of the other players can if they wish. On second down the New England run again, bringing up 3$^{rd}$ and 9. Nobody bets, and the light turns red as the teams line up for 3$^{rd}$ down. On third down the quarterback completes a pass to the wide receiver for a 23-yard gain to the 40-yard line resulting in a first down.

Everybody gets another card, and the green light goes on. Player B receives a Sack Card 616 and Player A receives a FG Card 607. At this point, Player A's hand is good since the WR card is already worth 23+5=28 points, and with the TD and FG cards, Player A has a very good chance of adding to that total. One potential problem is that there are other WR cards in the deck, and also that the QB cards 601 are worth just as much. Player A, perhaps bluffing that he has at least two of these good cards instead of just one, bets by clicking their bet button 407 on their player screen. The house places Player A's bet into the pot and begins the betting round. The clocks 408 on the other players' screens set to 15 seconds and start winding down.

Based on the timing of the bet, the other players may suspect that Player A either has a QB card 601 or a WR card 603 (or both). When the clock winds down, Player 3 (who made the bet on the second play of the drive) did not call, and so is out. Three other players also choose not to call, so they are out too. Three players (including Player B) hit the call button before the clock runs down, and are still in. There are four players left. The pot 403 has increased by 4×15=60 chips, so the total is now 180 chips.

The next couple of plays are big running plays, leading to another 1$^{st}$ down at the Denver 42-yard line. Nobody made a bet during that set of downs. The four remaining players get another card. Player A's fourth card is a 1$^{st}$ Downs card 613 which is worth 10 points already, so probably only a hand with two QB or WR cards would be able to beat Player A's hand. However, since Player A made the last bet, Player A cannot initiate a bet now.

At this time one of the other remaining players makes a bet. The house takes 20 chips from his stash, adds it to the pot, and sets the betting clock to 15 seconds. Perhaps the player that just bet has two QB cards, tempting other players to fold. Player B decides that the XFG card has a reasonable chance of being worth 30 points, and so clicks their call button before the clock runs down. Player B is therefore still in. One more player folds, so there are three players left. The pot increases by 3×20=60 chips, so the total is now 240. Since a different player has made the last initial bet, Player A can now place a new initial bet if desired.

The next set of downs goes poorly for the New England team, and they have 4$^{th}$ and 5 from the 37. Player A decides to bet again right after the light turns green since it is unlikely that another player will be able to beat their hand. Player B decides to call since a field goal attempt will be 53 yards, which has a good chance of missing making the XFG card a valuable card. The other remaining player also calls. The pot increases by another 3×20=60 chips, and now stands at 300. The New England team sets up for the FG, the red light goes on, and the field goal kicker misses. The drive is over. The values of the cards and hands can now be computed exactly, and the winner determined.

Player A's WR Card 603 is worth 28 points and their 1st Downs Card 613 is worth 10 points. (Player A's TD Card 606 and FG Card 607 are worth 0), so Player A's hand is worth 38 points. Player B's XFG Card 609 is worth 30 points, and since there was one 3rd down conversion, Player B gets another 5 points from their 3rd Down Conversion card 621 for a total of 35 points. The other remaining player had a Long Gain card 618, worth 23 points (since the 23-yard pass to the wide receiver was the longest gain of the drive), and nothing else. Player A has the best hand notwithstanding the missed field goal and wins the pot. Player A had 5+10+15+20+20=70 chips invested in the pot, and so receives a profit of 230 chips. The house adds the pot to Player A's chip stash, and the round is over.

The Denver team's offense comes onto the field, and the next round of DrivePoker can begin.

Having now fully described the present invention in some detail by way of illustration and examples for purposes of clarity of understanding, it will be obvious to one of ordinary skill in the art that the same can be performed by modifying or changing the invention within a wide and equivalent range of conditions, elements and other parameters without affecting the scope of the invention or any specific embodiment thereof, and that such modifications or changes are intended to be encompassed within the scope of the appended claims.

When a group of materials, compositions or components is disclosed herein, it is understood that all individual members of those groups and all subgroups thereof are disclosed separately. When a Markush group or other grouping is used herein, all individual members of the group and all combinations and subcombinations possible of the group are intended to be individually included in the disclosure. Every combination of components described or exemplified herein can be used to practice the invention, unless otherwise stated. In the disclosure and the claims, "and/or" means additionally or alternatively. Moreover, any use of a term in the singular also encompasses plural forms.

The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. The invention illustratively described herein suitably may be practiced in the absence of any element or elements, limitation or limitations which is not specifically disclosed herein. All headings used herein are for convenience only.

All publications referred to herein are incorporated herein to the extent not inconsistent herewith. Some references provided herein are incorporated by reference to provide details of additional uses of the invention. All patents and publications mentioned in the specification are indicative of the levels of skill of those skilled in the art to which the invention pertains. References cited herein are incorporated by reference herein in their entirety to indicate the state of the art as of their filing date and it is intended that this information can be employed herein, if needed, to exclude specific embodiments that are in the prior art.

What is claimed is:

1. A method of playing a betting game on electronic units through a computer network between a plurality of players, wherein said betting game is based on a live event comprising one or more betting events, each electronic unit comprising a screen, an interface, a processor and a non-transitory computer readable medium encoded with instructions and executed by the processor to perform the steps of:

a. providing a deck of cards, wherein said cards are electronic units maintained on a computer processor and each card has a value determined by actions occurring during the one or more betting events;

b. providing a player hand to each player by distributing a plurality of cards from said deck to each player through the computer network before or during a first betting event, wherein the value of the distributed cards is able to change during the course of the first betting event, and wherein each player hand has a value determined by combining the values of each card in said hand;

c. monitoring said live event until a termination event occurs with regard to the first betting event;

d. providing multiple asynchronous betting rounds during the first betting event until the termination event occurs, wherein during the betting rounds the plurality of players are allowed to place bets through the computer network on the value of the cards distributed to the players, wherein each of the multiple asynchronous betting rounds can be initiated at any time by any remaining player placing an initial bet and wherein any players who do not at least match said initial bet are disqualified;

e. upon termination of the first betting event:

1) determining a final value of the distributed cards for the terminated betting event, 2) determining a final value of each player hand by combining the final values of each card within the hand, and 3) paying winners of bets placed during said betting rounds for remaining players based on the final value of each remaining player hand.

2. The method of claim 1 wherein the live event is a sporting event.

3. The method of claim 2 wherein each card has a value based on statistics of a player or team accumulated during said one or more betting events.

4. The method of claim 1 further comprising:

a. distributing cards from said deck to each player through the computer network before or during a plurality of betting events, wherein the value of the distributed cards are able to change during the course of each betting event;

b. monitoring said live event until a termination event occurs with regard to the plurality of betting events;

c. providing multiple asynchronous betting rounds during each of the plurality of betting events until the termination event occurs for each betting event, wherein during the betting rounds the plurality of players are allowed to place bets through the computer network on the value of the cards distributed to the players;

d. upon termination of each of the plurality of betting events, determining the final value of the cards distributed to each player for the terminated betting event and paying winners of bets placed during said betting rounds for remaining players based on the final value of each remaining player hand.

5. The method of claim 1 further comprising collecting the bets placed during the betting rounds, and retaining a portion of the collected bets wherein the winners are paid the remaining portion of said collected bets.

6. The method of claim 1 further comprising collecting an ante from one or more players at the start of each betting round, and disqualifying players who do not contribute said ante, wherein disqualified players cannot be winners of bets placed during said betting rounds for that betting event.

7. The method of claim 6 further comprising retaining a portion of collected antes wherein the winners of said placed bets are paid the remaining portion of the collected antes.

8. The method of claim 1 further comprising providing a betting clock viewable by each player able to monitor time following each initial bet, wherein each remaining player is given a finite amount of time to at least match said initial bet before being disqualified.

9. The method of claim 8 wherein any player that is not disqualified can initiate a betting round at any time, with the exception that a player cannot institute a new betting round if that same player initiated the previous betting round.

10. The method of claim 1 wherein the number of betting rounds are not predetermined.

11. The method of claim 1 wherein said bets are placed using chips or tokens which are electronic units maintained on a processor.

12. A method of playing a betting game having multiple game rounds, between a plurality of players, the betting game having each game round based on one or more live events comprising one or more betting events, comprising the steps of:

a. providing one or more tables through a computer network, wherein each table is an electronic unit, each electronic unit having a screen, an interface, a processor and a non-transitory computer readable medium encoded with instructions and executed by the processor to perform the steps of:

i. providing a deck of cards to each table, wherein said cards are electronic units maintained on a computer processor and each card has a value determined by actions occurring during the one or more betting events;

ii. for each table, providing a player hand to each player by distributing a plurality of cards from the deck to each player at the table before or during one or more betting events, wherein the value of the distributed cards are able to change during the course of each betting event, and wherein each player hand has a value determined by combining the values of each card in said hand;

iii. monitoring said one or live events until a termination event occurs with regard to the one or more betting events;

iv. providing multiple asynchronous betting rounds for each table during the one or more betting events until the termination event occurs for each betting event, wherein during the betting rounds the plurality of players at each table are allowed to place bets through the computer network on the value of the cards distributed to the players, wherein each of the multiple asynchronous betting rounds can be initiated at any time by any remaining player placing an initial bet and wherein any players who do not at least match said initial bet are disqualified;

v. providing a betting clock viewable by each player able to monitor time following each initial bet, wherein each remaining player is given a finite amount of time to at least match said initial bet before being disqualified;

vi. upon termination of each of the one or more betting events:

1) determining a final value of the distributed cards for the terminated betting event, 2) determining a final value of each player hand by combining the final values of each card within the hand, and 3) paying winners of bets placed at each table during said betting rounds for remaining players based on the final value of each remaining player hand.

13. The method of claim 12 wherein said bets are placed using chips or tokens which are electronic units maintained on a processor.

14. The method of claim 13 wherein after one or more betting events, advancing players with the highest amount of chips or tokens from each table to the next game round, wherein the next game round comprises fewer tables and players.

15. The method of claim 12 further comprising collecting the bets placed during the betting rounds, and retaining a portion of the collected bets wherein the winners are paid the remaining portion of said collected bets.

16. The method of claim 12 wherein a game round is based on a live sporting event and each successive game round is based on a different live sporting event that begins after the previous game round is over.

17. A system for providing a betting game between a plurality of players, wherein said betting game is based on a live event comprising one or more betting events, where said system comprises:

a. a host processor programmed for analyzing and processing input data, and outputting data and information relevant to the betting game; said host processor programmed to:

1) provide a deck of cards, wherein each card has a value determined by actions occurring during the one or more betting events;

2) provide a player hand to each player by distributing a plurality of cards from said deck to each player before or during a first betting event, wherein the value of the distributed cards are able to change during the course of the first betting event, and wherein each player hand has a value determined by combining the values of each card in said hand;

3) monitor said live event until a termination event occurs with regard to the first betting event;

4) provide multiple asynchronous betting rounds during the first betting event until the termination event occurs, wherein during the betting rounds the plurality of players are allowed to place bets on the value of the cards distributed to the players through the computer network, wherein each of the multiple asynchronous betting rounds can be initiated at any time by any remaining player placing an initial bet and wherein any players who do not at least match said initial bet are disqualified;

5) provide a betting clock viewable by each player able to monitor time following each initial bet, wherein each remaining player is given a finite amount of time to at least match said initial bet before being disqualified; and 5) upon termination of the first betting event:

i. determine a final value of the distributed cards for the terminated betting event, ii. determine a final value of each player hand by combining the final values of each card within the hand, and iii. paying winners of bets placed during said betting rounds for remaining players based on the final value of each remaining player hand, wherein said bets are placed using chips or tokens and wherein said chips, tokens and cards are electronic units;

b. a plurality of player processors interactively connected to said host processor, said player processor able to send and receive data to said host processor; and c. a display and interface device operatively associated with each said player processor, said display and interface device able to display data received from said player processor, and able to send betting instructions entered by a player to said host processor through said player processor.

* * * * *